US005742865A

United States Patent [19]

Yajima et al.

[11] Patent Number: 5,742,865

[45] Date of Patent: Apr. 21, 1998

[54] APPARATUS FOR CONTROLLING TEMPERATURE OF FIXING DEVICE BY INCREASING THE TEMPERATURE FOR EACH SHEET OF A CONTINUOUS FIXING OPERATION

[75] Inventors: Hiroyuki Yajima; Zenji Takahashi, both of Tokyo, Japan

[73] Assignee: Oki Data Corporation, Tokyo, Japan

[21] Appl. No.: 686,944

[22] Filed: Jul. 26, 1996

[30] Foreign Application Priority Data

Jul. 28, 1995 [JP] Japan ..... 7-192985

[51] Int. Cl.[6] ..... G03G 15/00

[52] U.S. Cl. ..... 399/43; 399/69

[58] Field of Search ..... 399/45, 69, 43; 219/216

[56] References Cited

U.S. PATENT DOCUMENTS

| | | | |
|---|---|---|---|
| 4,825,242 | 4/1989 | Elter | 399/67 |
| 5,331,384 | 7/1994 | Otsuka | 399/45 |
| 5,481,346 | 1/1996 | Ohzeki et al. | 399/335 |
| 5,486,903 | 1/1996 | Kanno et al. | 399/45 |
| 5,512,992 | 4/1996 | Kim et al. | 399/69 |

FOREIGN PATENT DOCUMENTS 57-073773 5/1982 Japan .

*Primary Examiner*—Robert Beatty

*Attorney, Agent, or Firm*—Rabin, Champagne, & Lynt, P.C.

[57] ABSTRACT

An apparatus controls a temperature of a heat roller for fixing a developer material transferred on a print medium such as paper. The apparatus includes a controller, a sensor for detecting the thickness and/or width of a print medium such as paper, and a temperature-detecting element such as a thermistor for detecting the temperature on a first surface of the heat roller outside of a second surface area of the heat roller in contact with the print medium. The controller controls the temperature of the heat roller in accordance with the dimension of the print medium so that the middle portion of the heat roller is maintained substantially at a temperature of a first predetermined value during continued printing operation. The controller raises the temperature on the first surface stepwise in accordance with each page of the print medium during continued printing operation till the temperature on the first surface reaches a temperature of a second predetermined value, and maintains thereafter the temperature on the first surface at the second predetermined value during continued printing operation.

8 Claims, 8 Drawing Sheets

FIG.8

| PAPER WIDTH (mm) / REAM WEIGHT (kg) | ≤ 100 (POSTCARD, ENVELOPE,etc) | ≤ 210 | ≤ 260 | ≤ 328 |
|---|---|---|---|---|
| ≤ 55 | P11 | P21 | P31 | P41 |
| ≤ 70 | P12 | P22 | P32 | P42 |
| ≤ 90 | P13 | P23 | P33 | P43 |
| ≤ 110 | P14 | P24 | P34 | P44 |
| ≤ 135 | P15 | P25 | P35 | P45 |
| > 135 | P16 | P26 | P36 | P46 |
| OTHER MEDIUM (OHP,etc) | P17 | P27 | P37 | P47 |

APPARATUS FOR CONTROLLING TEMPERATURE OF FIXING DEVICE BY INCREASING THE TEMPERATURE FOR EACH SHEET OF A CONTINUOUS FIXING OPERATION

BACKGROUND OF THE INVENTION

The present invention relates to an apparatus for controlling the temperature of a fixing device which uses a heat roller, the apparatus being used in an electrophotographic recording apparatus such as an electrophotographic printer.

In recent years, fixing devices used in, for example, electrophotographic printers, have been of a heater type which includes a heat roller and a pressure roller in pressure contact with the heat roller. The print paper is fed in a laterally centered position with respect to the heat roller and the pressure roller. This type of fixing device provides a variety of advantages such as high heat efficiency over other types of fixing device. Temperature control of a heat roller is effected by the use of a thermistor which is provided in slidable contact with the surface of the heat roller to detect the surface temperature of the heat roller.

A problem with such a prior art fixing device is that the toner particles adhere to the thermistor if the thermistor is provided within a surface area of the heat roller which serves to fix the toner image and the toner particles cause the heat roller to wear out. Wear of the heat roller leads to degraded print quality. In order to address this drawback of the prior art device, an apparatus has been proposed which has a thermistor provided outside of the fixing area of the heat roller.

With such an apparatus, when continuous printing is performed on some pages of paper having a relatively narrow width, the temperature of the heat roller decreases more greatly at a longitudinally middle portion of the heat roller than at a longitudinal end portion where the thermistor is disposed. Printing on paper of a size larger than A3 size is more often conducted than before, and therefore the thermistor must be mounted at a location considerably away from the middle portion of the heat roller. In addition, manually fed paper can be as thick as 0.2 mm. Thicker paper such as post cards and envelopes causes the surface temperature of middle portion of the heat roller to greatly decrease and this temperature decrease becomes more prominent with decreasing paper width. This makes it difficult to ensure good fixing performance.

SUMMARY OF THE INVENTION

The present invention provides an apparatus for controlling the temperature of a heat roller which fuses a developer material transferred on a print medium such as paper. A sensor detects the thickness and width of a print medium such as paper. A temperature-detecting element such as a thermistor detects the temperature on the surface of the heat roller outside of a surface area which is in contact with the print medium. A controller controls the temperature of the heat roller in accordance with the dimension such as width or thickness of the print medium so that the middle portion of the heat roller is maintained substantially at a predetermined temperature during continued printing operation.

Further, the controller raises stepwise the temperature on the surface of the heat roller outside of the surface area in contact with the print medium in accordance with a cumulative number of pages of the print medium during continued printing operation till the temperature detected by the thermistor reaches a predetermined value, and thereafter maintains the temperature at the predetermined value during continued printing operation.

A plurality of control programs may be stored in a memory, each of the programs corresponding to a combination of the thickness and width of the print medium. The controller raises the temperature detected by the thermistor in increments determined by the control program corresponding to a specific combination of the thickness and width of the print medium.

BRIEF DESCRIPTION OF THE DRAWINGS

FIG. 8 shows a table in which program numbers P11–P47 of the control programs used in the second embodiment are listed.

DETAILED DESCRIPTION OF THE INVENTION

The embodiments of the invention will be described with reference to the drawings. Like elements have been given like numerals throughout the drawings.

First Embodiment

Figure 1A:
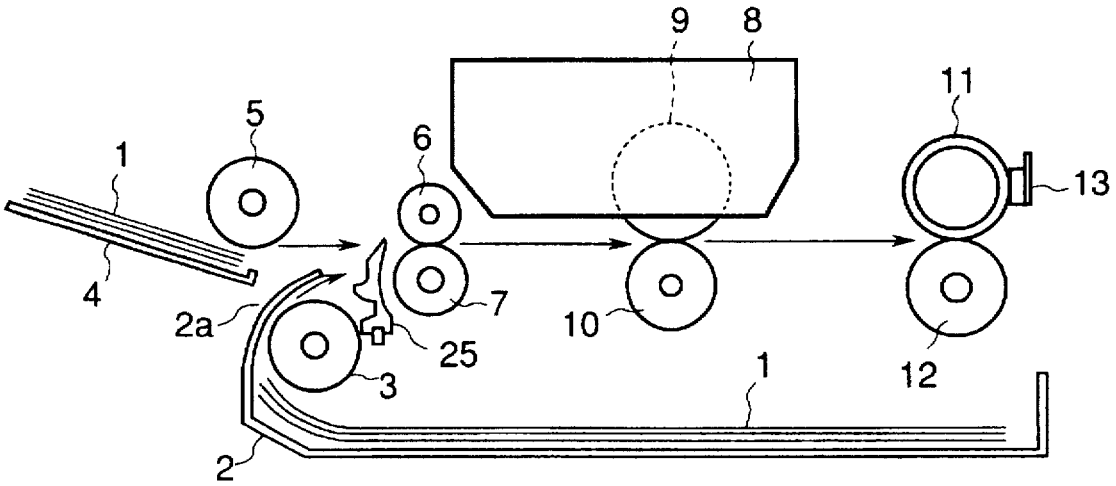
FIG. 1A illustrates a general construction of an electrophotographic printer, according to the present invention.

FIG. 1A illustrates a general construction of an electrophotographic printer according to a first embodiment. Referring to FIG. 1A, a paper cassette 2 holds a print medium such as print paper 1 therein and is disposed at a lower location of the printer. A feed roller 3 is provided at one end of the paper cassette 2 and feeds the print paper 1 to a pair of feed rollers 6 and 7. A manually feeding slot 4 is provided on the left end of the printer and a feed roller 5 is disposed at a slot exit through which the print paper 1 is fed from the feeding slot 4 into the printer. The pair of feed rollers 6 and 7 are in pressure contact with each other and disposed downstream of the feed roller 5 and the feed roller 3. The feed roller 6 is made of a metal and the feed roller 7 is made of rubber. Downstream of the feed rollers 6 and 7 is provided an electrophotographic processing unit 8, which holds a photosensitive drum 9 therein in contact with a transfer roller 10. A heat roller 11 and a pressure roller 12 are in contact with each other and are disposed downstream of the electrophotographic processing unit 8. On the surface of the heat roller 11 is mounted a thermistor 13 to detect the surface temperature of the heat roller 11. The print paper 1 is transported along in a direction of the arrows.

Figure 1B:
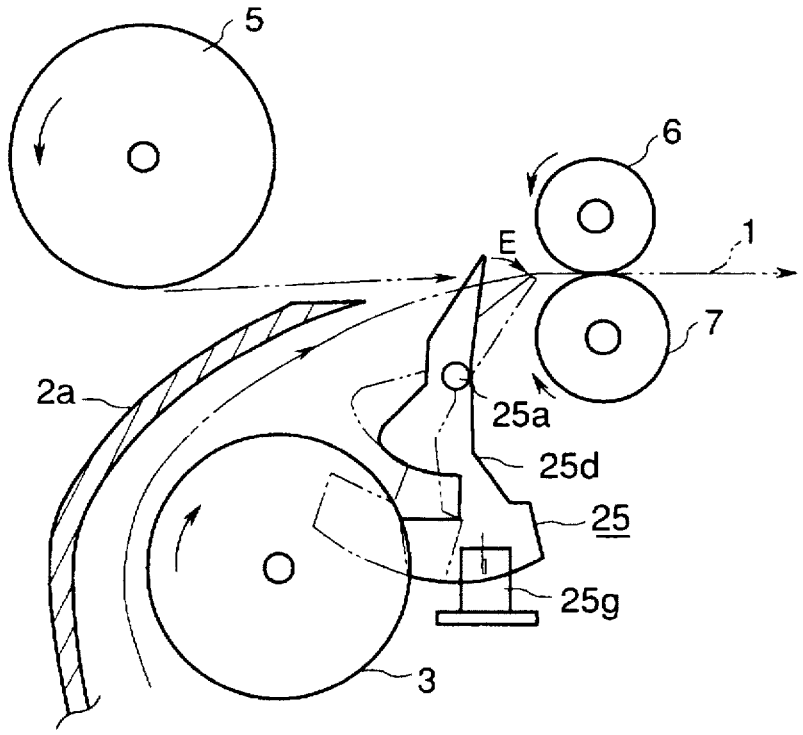
FIG. 1B illustrates the detail of the paper sensor shown in FIG. 1A.
Figure 1C:
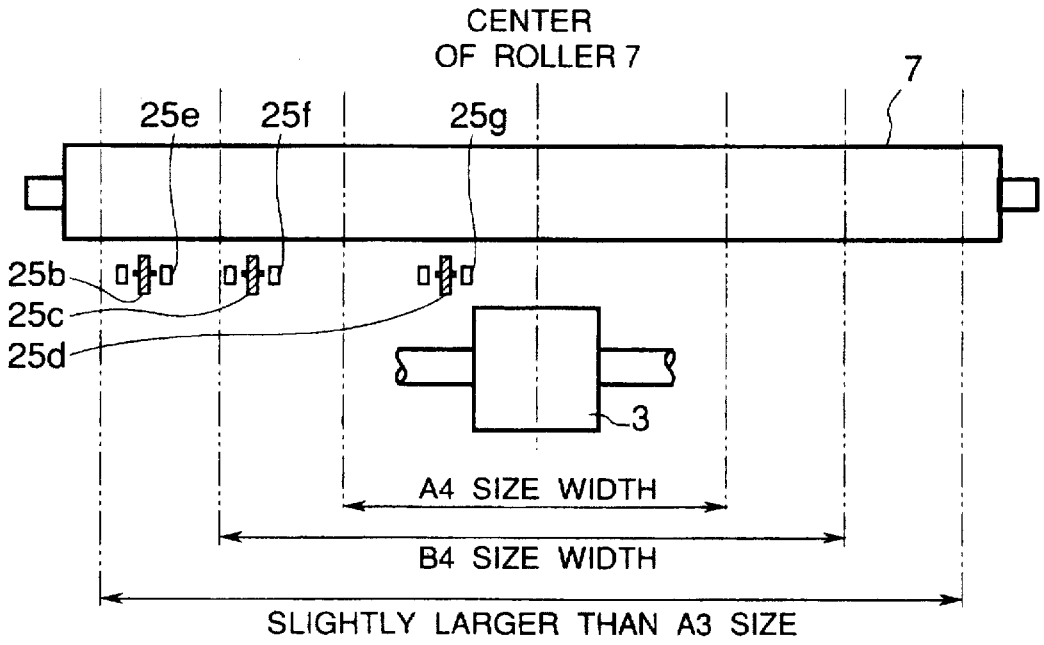
FIG. 1C is a top view of FIG. 1B, showing elements of the paper sensor.

A sensor 25 for detecting the width of print paper 1 is disposed immediately upstream of the feed rollers 6 and 7 in FIG. 1A, and outputs a signal indicating the width of the print paper 1 passing therethrough. FIG. 1B is a side view of the sensor 25 and FIG. 1C is a top view of the sensor 25, feed roller 7, and the feed roller 3. Referring to FIG. 1B, the sensor 25 includes for example, three independent elements 25*b*–25*d* rotatably mounted on a shaft 25*a* and aligned in order as shown in FIG. 1C. Each of the elements 25*b*–25*d* has an upper free end and a lower free end. The elements 25*b*–25*d* cooperate with photo interrupters 25*e*–25*g*, each element cooperating with the corresponding photo interrupter. In FIG. 1B, only the photo interrupter 25*g* of the element 25*d* is shown. The print paper 1 is fed toward the feed rollers 6 and 7 either by the feed roller 3 along a guide 2*a* or by the feed roller 5. When the print paper 1 passes over the sensor 25, the print paper 1 pushes down the upper free ends of all the elements under the print paper 1 being fed. The print paper 1 is then fed in a laterally centered position with respect to the feed rollers 6 and 7 as shown in FIG. 1C.

For example, when the print paper 1 of a A4 size width is fed toward the feed rollers 6 and 7, the print paper 1 pushes the upper free end of the element 25*d* thereunder, causing the element 25*d* to swing about the shaft 25*a* in a direction shown by arrow E to a dash-dot line position. When the element 25*d* swings, the lower free end portion of the element 25*d* opens the optical path of the photo interrupter 25*g* which in turn outputs a signal indicative of detection of the print paper 1 to a later described control circuit. After the print paper 1 has passed the sensor 25, the element 25*d* swings back to its original position by its gravity.

If the print paper 1 is of B4 size width, both the elements 25*c* and 25*d* are pushed to swing in the direction shown by arrow E, the corresponding photo interrupters 25*f* and 25*g* outputting a signal indicative of the detection of the print paper 1.

If the print paper 1 is of a size slightly larger than A3 size, all the elements 25*b*, 25*c*, and 25*d* are pushed down to swing in the direction shown by arrow E, the corresponding photo interrupters 25*e*, 25*f*, and 25*g* each outputting a signal indicative of the detection of the print paper 1.

Figure 2:
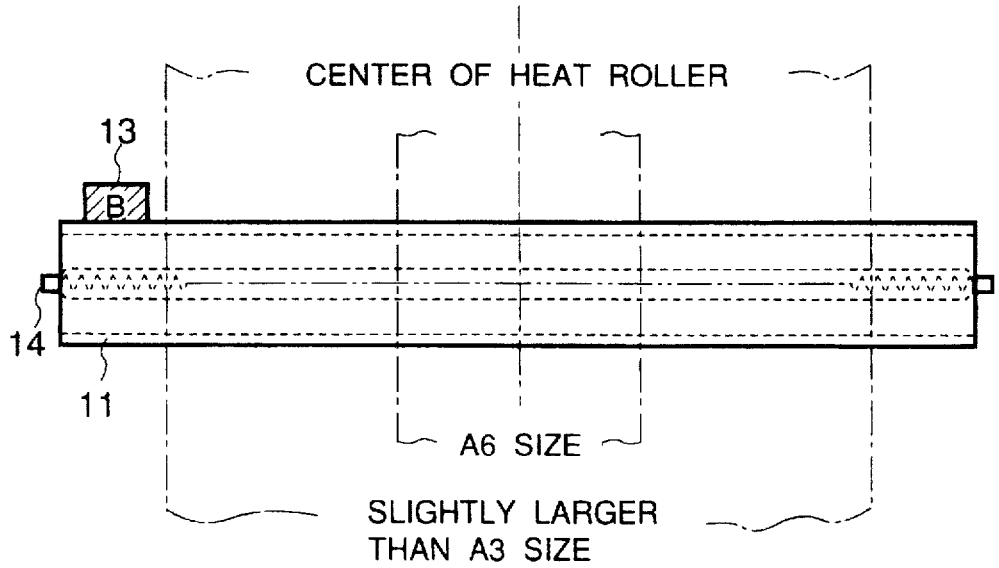
FIG. 2 illustrates the positional relation between the thermistor and the print paper.

FIG. 2 illustrates the positional relation between the thermistor 13 and the print paper 1. Referring to FIG. 2, the thermistor 13 is mounted on the surface of a longitudinal end of the heat roller 11, outside of an area which contacts with the print paper 1 having a maximum width (the width 328 mm of the paper having a 328×453 mm size, i.e., somewhat larger than A3 size). The heat roller 11 incorporates a halogen lamp which serves as a heater 14. The print paper 1 is usually fed to the heat roller 11 in a laterally centered position. Therefore, disposing the thermistor 13 outside of the maximum paper width ensures that for any sizes of print paper 1, the thermistor 13 is always outside of the area in which toner image is fixed.

Figure 3:
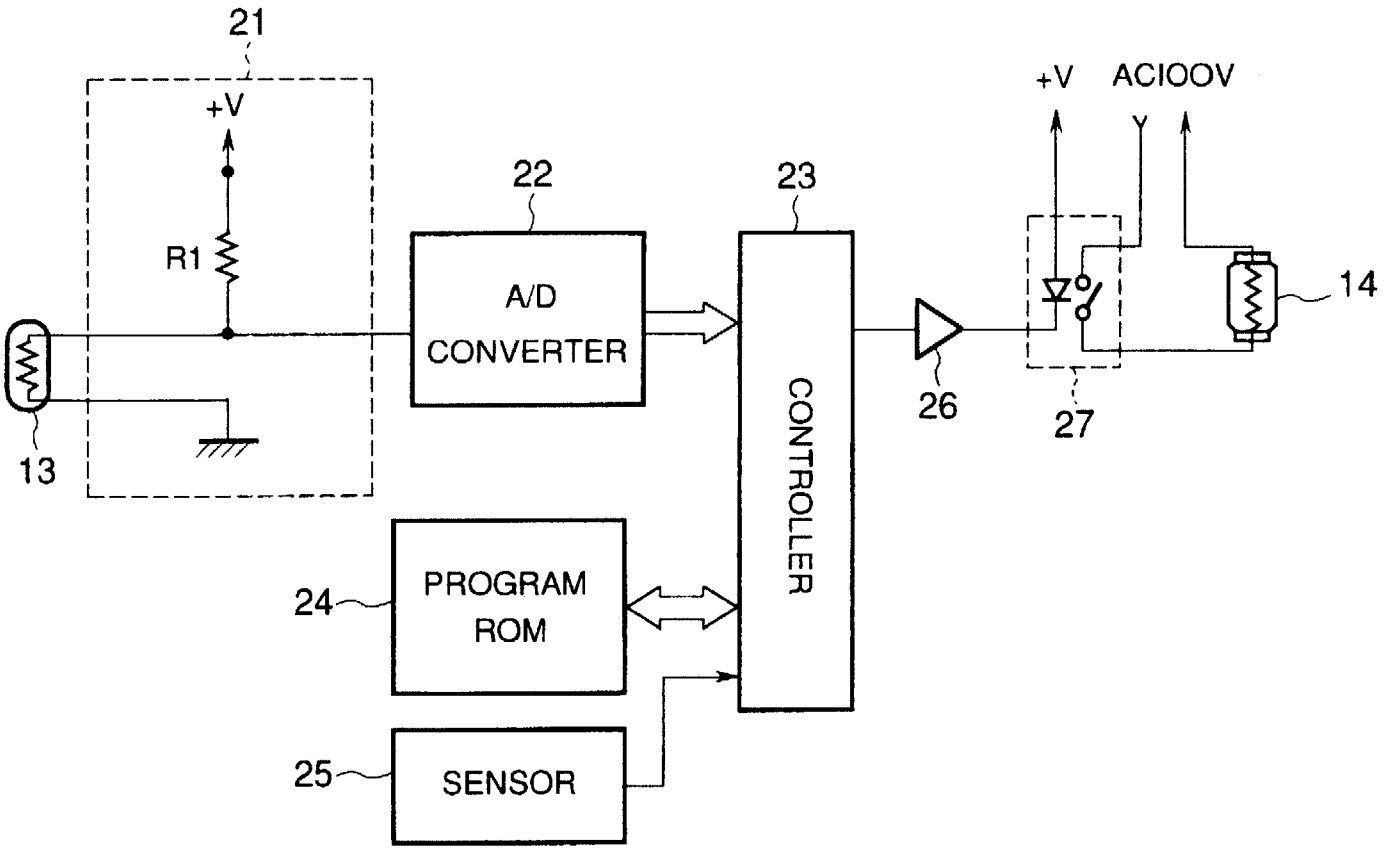
FIG. 3 illustrates a control circuit for controlling the temperature of the fixing device of the first embodiment.

FIG. 3 illustrates a control circuit for controlling the temperature of the fixing device. Referring to FIG. 3, the thermistor 13 is connected to a temperature detection circuit 21 and then to a controller 23 via an A/D converter 22. The controller 23 takes the form of, for example, a microcomputer and controls the overall operation of temperature control of the fixing device in the first embodiment. The resistance of the thermistor 13 decreases with increasing temperature. The temperature detection circuit 21 includes a power supply +V and a resistor R1 and detects the temperature of the heat roller 11 in terms of an analog voltage across the thermistor 13. The A/D converter 22 converts the analog voltage into an 8-bit digital signal and sends the digital signal to the controller 23.

Stored in the program ROM 24 is a program used for controlling the temperature in the fixing operation. Later described upper limits $T_H$ of surface temperature of the heat roller 11 corresponding to the widths of the print paper 1 are also stored in the ROM 24. The controller 23 is also connected to a buffer circuit 26 which in turn is connected to the heater 14 via a relay switch 27. The controller 23 sends a signal to the relay switch 27 to controllably open and close the contacts of the relay switch 27. One of the contacts of the relay switch 27 is connected with the heater 14 and the other is connected to an AC power supply (100 V). Thus, the output signal from the controller 23 controls the heater 14 to turn on and off. The sensor 25 detects the width of the print paper 1 and sends a signal indicative of the width to the controller 23.

Figure 4:
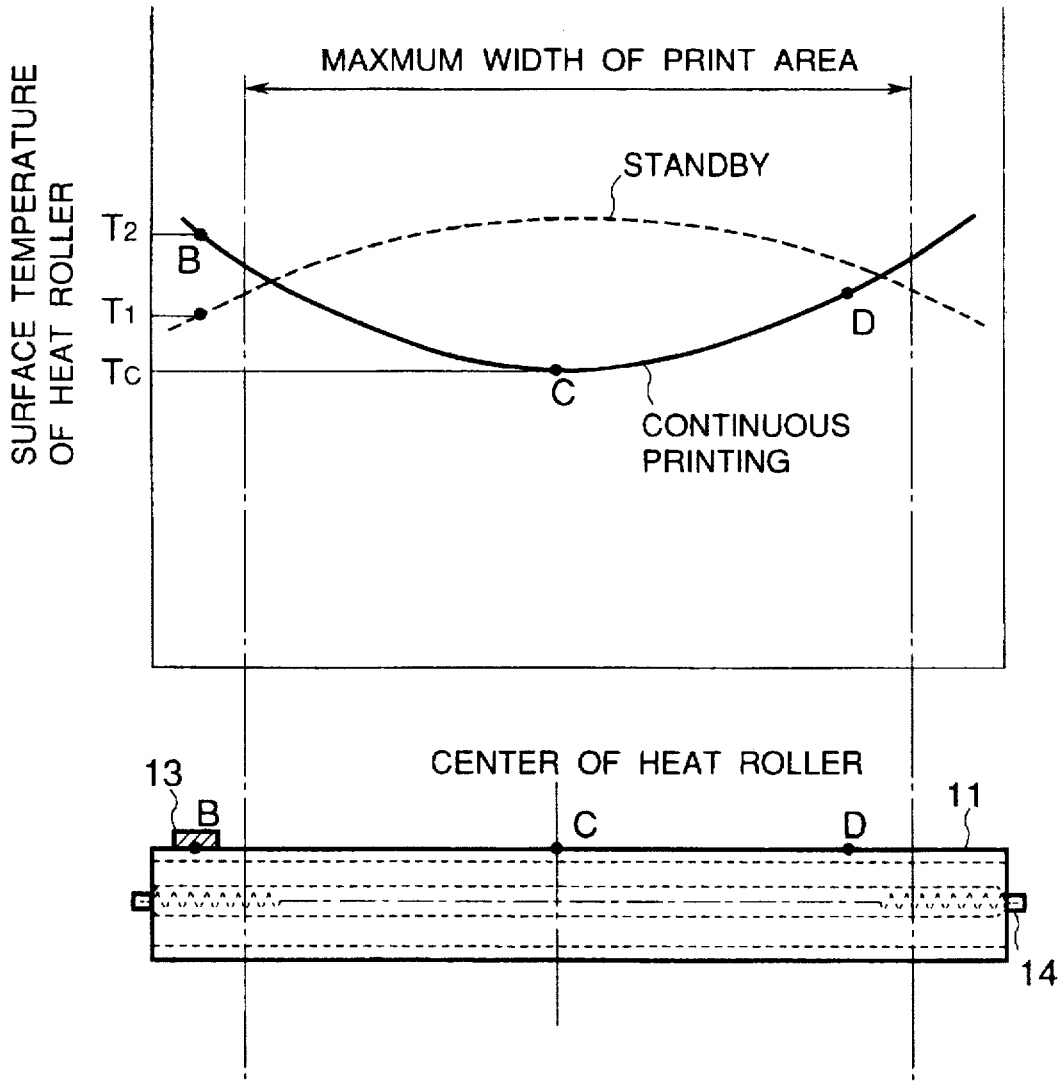
FIG. 4 illustrates the distribution of the surface temperature of a heat roller of the first embodiment.

The behavior of the surface temperature of the heat roller will now be described. FIG. 4 illustrates the profile of the surface temperature of the heat roller 11. Referring to FIG. 4, the thermistor 13 for detecting the surface temperature is disposed outside of the surface area on the heat roller 11 in which the toner image is fixed. Temperature is plotted on the vertical axis and position on the heat roller 11 on the horizontal axis. The dotted-line curve shows the temperature of the heat roller 11 in the standby mode and is of a generally convexed shape with a maximum value in the middle. The dotted-line curve varies somewhat depending on the arrangement of heat-generating elements of the halogen lamp used as the heater 14. The solid line curve shows the temperature of the heat roller 11 in the saturation state during continuous printing and is of a generally concaved shape with a minimum value Tc in the middle. The temperatures T1 and T2 are detected by the thermistor 13. T1 indicating standby temperature in the standby mode and T2 the temperature in the continuous printing mode.

As is seen from FIG. 4, the temperature on the middle portion of the heat roller 11 is slightly higher than the temperature T2 in the standby mode but decreases to Tc in the continuous printing mode. Decreases in temperature at the middle portion of the heat roller 11 becomes more prominent with increasing thickness of and decreasing width of the print paper 1. For example, post cards and envelopes have increased thickness and decreased width.

Figure 5:
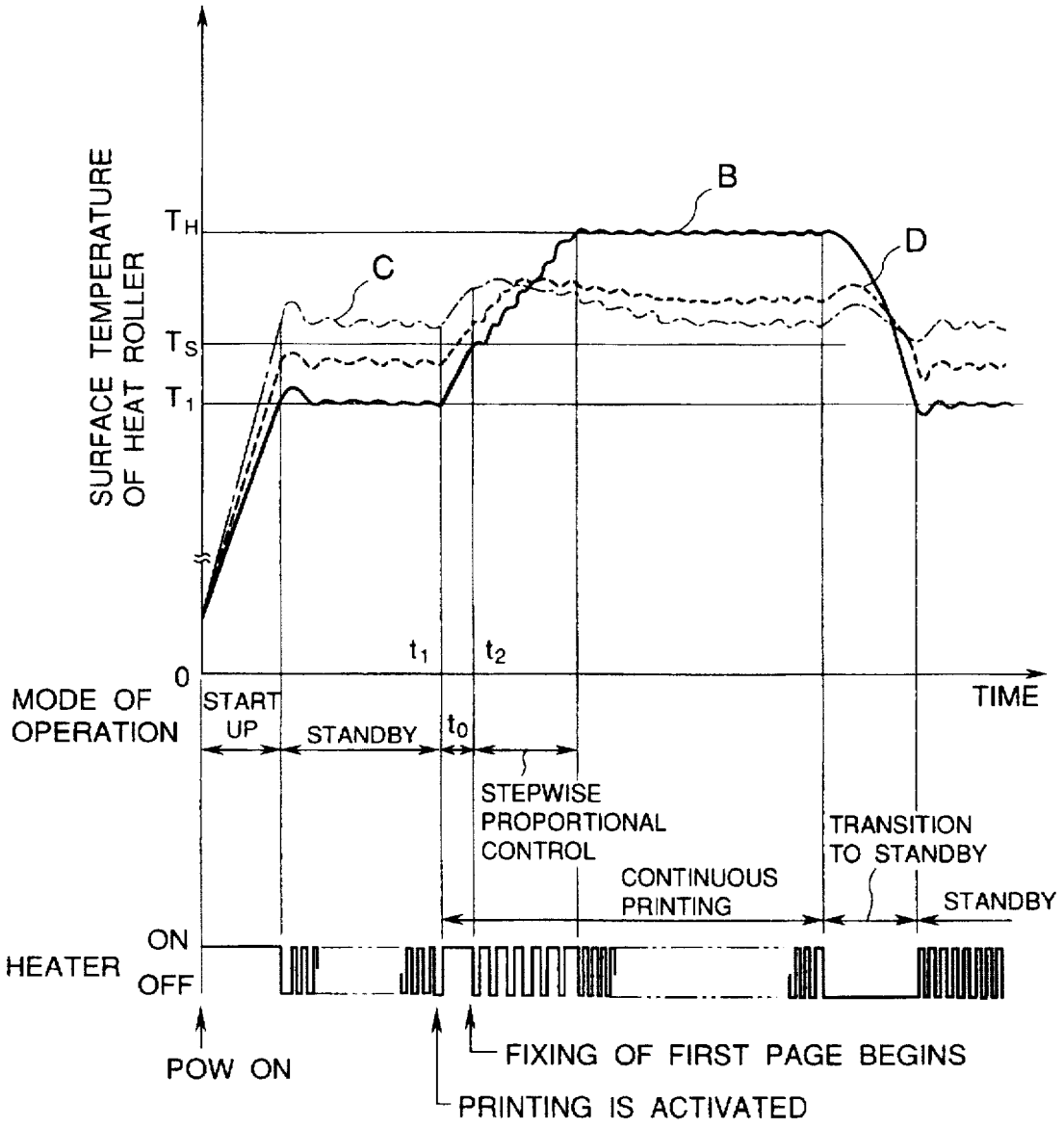
FIG. 5 illustrates temperature profile across the length of the heat roller according to the first embodiment.

FIG. 5 illustrates temperatures on points B, C, and D on the heat roller 11 shown in FIG. 4, changing with time. The curves in FIG. 5 are plotted with time on the horizontal axis and temperature on the vertical axis. FIG. 5 also shows timings at which the heater 14 is turned on and off. The solid-line curve shows changes in temperature at the position B on the heat roller 11 at which the thermistor 13 is mounted, the dot-dash-line curve shows changes in temperature at position C in the middle of the heat roller 11, and the dotted-line curve shows changes in temperature at position D which is at an end portion close to and within a maximum width of the print paper 1.

The operation of the first embodiment will be described with reference to FIG. 5. In the first embodiment, the resolution of temperature control is assumed to be about 2+ C.

When the printer is turned on, the control enters the start-up mode where energization of the heater 14 begins and continues till the temperature of position B reaches standby temperature T1. After the temperature of position B has reached standby temperature T1, the control enters the standby mode where the heater 14 cycles on and off to maintain the temperature of position B to standby temperature T1. In this mode, the temperatures of positions C and D are higher than standby temperature T1 of position B.

When the print initiation signal activates the continuous printing mode at time $t_1$, the heat roller 11 is set for the minimum required temperature Ts. Thus, the heater 14 is thereafter kept on until the temperature at point B reaches the minimum required temperature Ts at time $t_2$. The temperatures of positions C and D also increase. During the time duration $t_0$ between time $t_1$ and $t_2$, the print paper 1 is transported toward the heat roller 11. The leading edge of the first page of print paper 1 arrives at the heat roller 11 at time $t_2$. At time $t_2$, the operation enters the stepwise proportional control mode where the temperature setting of point B on the heat roller 11 is increased stepwise as the cumulative number of continuously printed pages increases. The fixing of the first page begins when the temperature of position B has reached the minimum required temperature Ts.

Upon completion of the fixing of the first page, the controller 23 increases the temperature setting of position B by about 2° C. so that the fixing of the second page is effected with the temperature of position B increased by about 2° C. In this manner, the temperature setting of point B is increased by about 2° C. for every succeeding page. Thus, the temperature of point B will have increased by about 8° C. from the minimum required temperature Ts when, for example, the fifth page is fixed. As a plurality of pages are printed in succession, the temperature of point B increases stepwise while the temperatures of points C and D do not increase as significantly as the temperature of point B. This is due to the fact that some of the heat of points C and D is transported to the print paper 1 during successive fixing. Consequently, the temperatures of points C and D remain somewhat higher than the minimum required temperature Ts as is seen from FIG. 5. From the fact that points C and D are within the fixing area, the fixing area is maintained at a substantially constant temperature somewhat higher than the minimum required temperature Ts, providing desirable fixing performance.

After the temperature of point B has reached the upper limit temperature $T_H$, the temperature of point B is maintained at the upper limit temperature $T_H$ by turning on and off the heater 14. The value of upper limit temperature $T_H$ is determined experimentally and varies depending on the detected width of the print paper 1. The upper limit temperature $T_H$ and the width of print paper 1 are in the following relationship. If the print paper 1 is relatively narrow, e.g., A6 size, the lateral edge of the print paper 1 is sufficiently away from the thermistor 13 as shown in FIG. 2. Thus, the surface of the heat roller 11 near the thermistor 13 does not contact the print paper 1 and therefore a significant amount of heat is not transferred to the print paper 1. In contrast, if the print paper 1 is wide, the lateral edge of the print paper 1 is close to the thermistor 13. Thus, a considerable amount of heat is transferred to the print paper 1 from the surface of the heat roller 11 near the thermistor 13, the temperature of the surface of the heat roller 11 decreasing significantly. This implies that the temperature at point B needs to be higher for wider print paper 1 than for narrower print paper 1 in order to maintain the middle surface, i.e., point C, of the heat roller 11 at substantially the same temperature. In other words, the narrower the print paper 1 is, the higher the upper limit temperature $T_H$ must be.

The settings of the upper limit temperature $T_H$ for different values of paper width are stored in a program ROM 24 in FIG. 3. When the sensor 25 detects the width of the print paper 1, the controller 23 reads from the ROM 24 a setting of the upper limit temperature $T_H$ corresponding to the detected width of the print paper 1. Maintaining the temperature at point B to the upper limit temperature $T_H$ allows the temperatures at points C and D to remain substantially constant values, somewhat higher than the minimum required temperature Ts for succeeding pages, ensuring quality fixing.

The temperature of the surface of the heat roller 11 in contact with the print paper 1 is dependent on an amount of heat transferred to the print paper 1 and an amount of heat supplied by the heater 14. Other factors that affect the temperature of the surface of the heat roller 11 include the heat conductivity of the material of the heat roller 11 and the heat capacity determined by the thickness of the metal pipe that forms the heat roller 11. Thus, the upper limit temperature $T_H$ is experimentally determined for each width of the print paper 1.

The heater 14 is turned off after continuous printing and the temperature of point B gradually decreases during transition to standby mode. Likewise, the temperatures at points C and D decrease. When the temperature at point B has decreased to standby temperature T1, the controller 23 enters the standby mode where the heater 14 again cycles on and off so as to maintain the temperature at point B to standby temperature T1. If the continuous printing mode is again activated while the temperature at point B is decreasing toward the standby temperature T1, the temperature of point B is increased from that temperature by about 2° C. for every succeeding page. After having reached the upper limit temperature $T_H$, the temperature at point B is maintained at the upper limit temperature $T_H$.

As mentioned above, the surface of the heat roller 11 is maintained at a temperature somewhat higher than the minimum required temperature Ts when continuous printing is being effected. Therefore, wrinkles will not be developed in the print paper 1 when the print paper 1 passes between the heat roller 11 and the pressure roller 12. This ensures quality fixing.

In the aforementioned first embodiment, while the temperature at point B is increased in increments of about 2° C. in the stepwise proportional control mode, the temperature may be increased in increments of about 4° C. or 6° C. depending on the desired resolution of temperature control and heat conductivity and heat capacity of the heat roller 11.

Although the width of the print paper 1 is detected by the sensor 25 in the aforementioned embodiment, width of the print paper 1 may be inputted from the operating panel of the printer.

Second Embodiment

Figure 6:
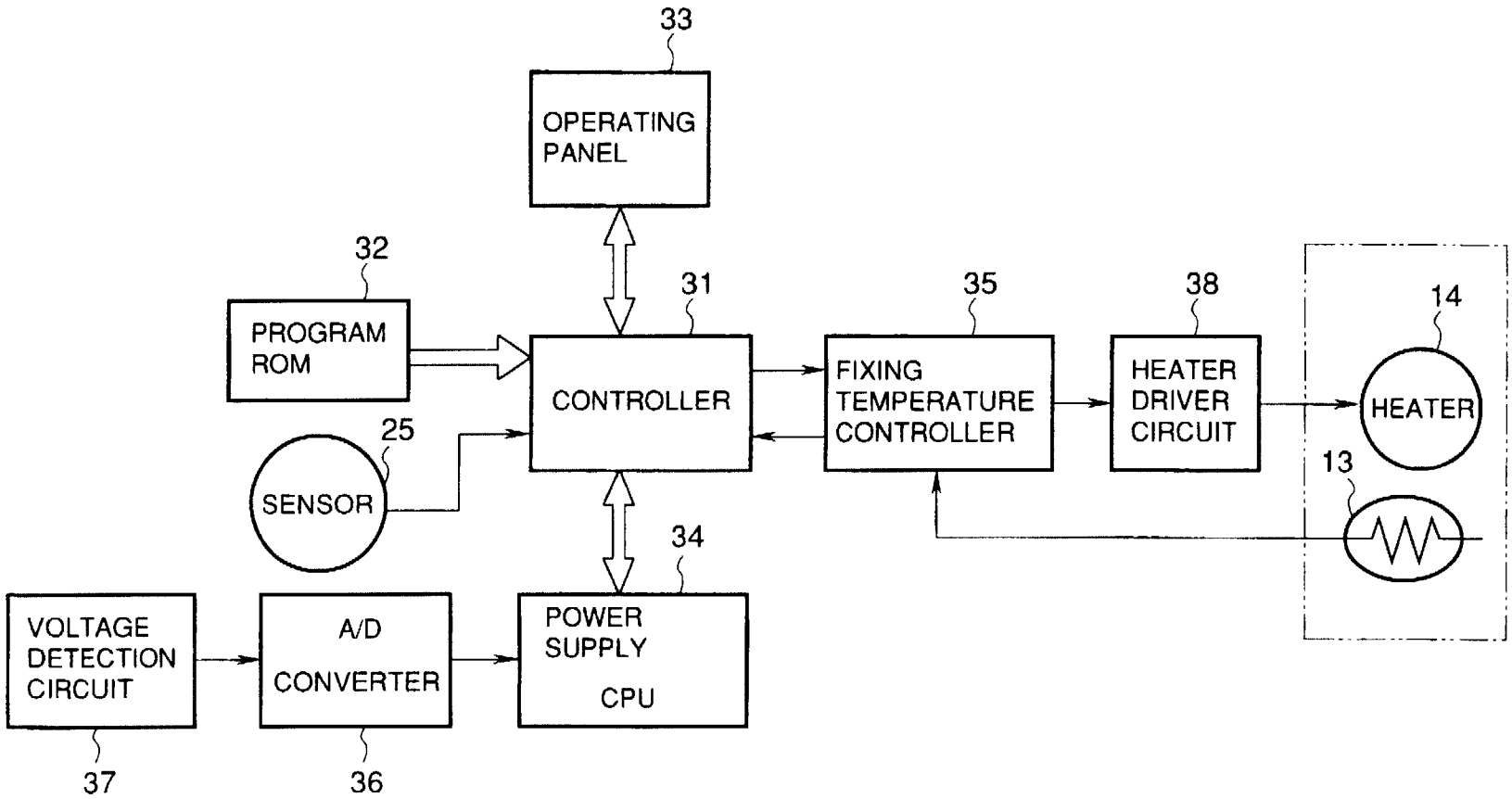
FIG. 6 is a block diagram showing a control circuit for controlling the temperature of the fixing device of a second embodiment.

The second embodiment will now be described. FIG. 6 is a block diagram showing a control circuit according to a second embodiment. Referring to FIG. 6, a controller 81 takes the form of, for example, microcomputer and controls the overall operation of the electrophotographic printer under control of a control program stored in a ROM 32. The controller 31 is connected to an operating panel 33, sensor 25, power supply CPU 34, and fixing temperature controller 35 for the fixing device. The operating panel 88 is operated by the operator to input various settings including paper size. The sensor 25 takes the same form as that in the first embodiment and detects the width of print paper 1.

A voltage detection circuit 37 detects a voltage Vo across a later described resistor Rx when a high voltage Vo is applied across the shaft 6*a* of the feed rollers 6 and the shaft 7*a* of the feed roller 7 with the print paper 1 sandwiched between the rollers 6 and 7. The output of the voltage detection circuit 37 is fed to an A/D converter 36 which converts the voltage Vo into a digital signal. The digital output of the A/D converter 36 is fed to the controller 31 via the power supply CPU 34. The power supply CPU 34 controls high voltages applied to, for example, a developer not shown. The digital output of the A/D converter 36 may be directly connected to the controller 31. The fixing temperature controller 35 controls the temperature of the heater 14 and is connected to a heater drive circuit 38 that drives the heater 14. The fixing temperature controller 35 is also connected to the thermistor 13. The thermistor 13 is mounted to the surface of the heat roller 11 outside of the surface area in contact with the print paper 1.

Figure 7:
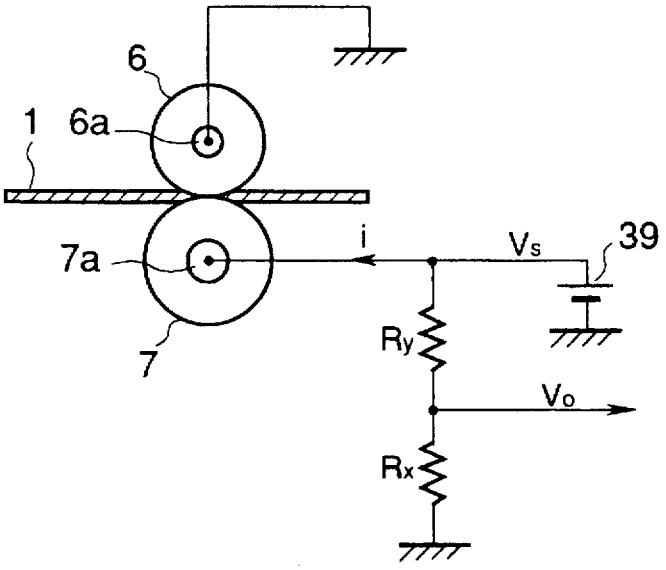
FIG. 7 is a circuit diagram showing a voltage detection circuit.

FIG. 7 is a circuit diagram showing the detail of the voltage detection circuit 37. Referring to FIG. 7, the shaft 6a of the feed roller 6 is electrically grounded and the shaft 7a of the feed roller 7 is connected to a high-voltage constant-current power supply 39. A series circuit of a resistor Ry and Rx is connected across the high-voltage constant-current power supply 39. The junction point of the resistors Ry and Rx is connected to the A/D converter 36. When the high voltage Vs is applied between the shafts 7a and 6a, the voltage Vo across the resistor Rx is directed to the A/D converter 36.

The resistance Rp of the print paper 1 is determined in terms of the voltage Vo as follows:

$$\begin{aligned} VS &= (Rr + Rp)i \qquad (1) \\ VO &= RxVs/(Rx + Ry) \\ &= Rx(Rr + Rp)i/(Rx + Ry) \end{aligned}$$

where Rr is the resistance of the roller 7, Rp is the resistance of the print paper 1, and i is the substantially constant current flowing through the series circuit of Rp and Rr.

From Eq. (1), Rp is given as follows:

$$Rp=\{Vo(Rx+Ry)/iRx\}-Ry \qquad (2)$$

The current i is of the order of several μA to several tens μA, and the resistances Rr and Rp are of the order of $10^8$ ohms and $10^{10}$ ohms. On the right hand side of Eq. (2), all values except for Vo are fixed values. A value of Vo in the range of nearly zero to five volts can be obtained for the print paper 1 under consideration by properly selecting the values of resistors Rx and Ry.

FIG. 8 shows a table in which program numbers P11–P47 of the control programs used in the second embodiment are listed in matrix form according to the size and ream weight (or thickness) of the print paper. Ream weight is a weight in kilogram of a predetermined number of sheets of print paper used by paper manufacturers. The larger the value of ream weight is, the thicker the print paper is. Thus the ream weight is indicative of the thickness of print paper. As is clear from FIG. 8, a particular program is used for each combination of thickness and width of print paper. These programs are stored in the ROM 32.

The operation of the second embodiment will now described. When the print paper 1 is fed into the printer, the sensor 25 detects the width of the print paper 1 or the operator inputs the width of the print paper 1 from the operating panel 33, and a signal indicative of the width is directed to the controller 31. When the print paper 1 is fed between the feed rollers 6 and 7, the high-voltage constant-current power supply 39 applies a high voltage to the shaft 7a of the feed roller 7. The high voltage causes a current to flow through the feed roller 7, print paper 1, and feed roller 6 and 7, so that the output voltage Vs of the power supply 39 is divided by the resistors Rx and Ry and the voltage Vo is outputted. The voltage Vo is converted into a digital signal by the A/D converter 36. The digital signal is sent to the power supply CPU 34 and then to the controller 31. The resistance of the print paper 1 is determined from the voltage Vo. The higher the resistance is, the thicker the print paper 1 is. Therefore, the thickness of the print paper 1 is determined from the resistance of the print paper 1.

The controller 31 reads from the ROM 32 a control program corresponding to the combination of width and resistance of the print paper 1, and then executes the control program to control the fixing temperature controller 35. Specifically, the upper limit temperature $T_H$ in the continuous printing mode is set in accordance with the width and thickness of the print paper 1 being printed. In the second embodiment, the temperature at point B is incremented stepwise from the minimum required temperature T2 to the upper limit temperature $T_H$ in the stepwise proportional control mode.

In the second embodiment, the upper limit temperature $T_H$ is determined on the basis of the width and the thickness of the print medium. However, the upper limit temperature $T_H$ may be determined on the basis of the thickness.

What is claimed is:

1. An apparatus for controlling a temperature of a heat roller for fixing a developer material transferred on a print medium, comprising:

a dimension detector for detecting a dimension of a print medium, up to a maximum size greater than A3 size, fed to the heat roller in a laterally centered position; and a controller for increasing a surface temperature of the heat roller by a predetermined amount, after each page of the print medium is printed and fixed, in a continued printing operation, so that a middle portion of the heat roller is maintained substantially at a temperature of a first predetermined value during the continued printing operation.

2. The apparatus according to claim 1, further including a temperature-detecting element for detecting a temperature on a first surface area of the heat roller outside of a second surface area of the heat roller, said second surface area being in contact with the print medium, wherein said controller controls the temperature on said middle portion on the basis of the temperature on said first surface area.

3. The apparatus according to claim 2, wherein said controller raises the temperature on said first surface area till the temperature on said first surface area reaches a second predetermined value, and said controller maintains the temperature on said first surface area at said second predetermined value during the continued printing operation after the temperature on said first surface area has reached said second predetermined value so that the temperature on said middle portion is maintained substantially at said first predetermined value.

4. The apparatus according to claim 2, further including a memory in which a plurality of control programs are stored, wherein the temperature on said first surface area is raised under control of one of said plurality of control programs corresponding to the dimension of the print medium.

5. The apparatus according to claim 1, wherein the dimension is a thickness of the print medium.

6. The apparatus according to claim 5, wherein the thickness is measured in terms of an electrical resistance of the print medium measured in a direction of thickness.

7. The apparatus according to claim 1, wherein the dimension is a width of the print medium, the width being measured perpendicular to a direction in which the print medium is fed to the heat roller.

8. The apparatus according to claim 1, wherein the dimension includes a thickness and a width of the print medium, the thickness being in terms of an electrical resistance of the print medium measured in a direction of the thickness of the print medium, and the width being measured perpendicular to a direction in which the print medium is fed to the heat roller.

* * * * *